US009789710B2

(12) United States Patent
Sugimoto

(10) Patent No.: US 9,789,710 B2
(45) Date of Patent: Oct. 17, 2017

(54) PRINTER AND PAPER CUT DETECTION METHOD

(71) Applicant: Seiko Epson Corporation, Tokyo (JP)

(72) Inventor: Takuya Sugimoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/221,177

(22) Filed: Jul. 27, 2016

(65) Prior Publication Data

US 2017/0028748 A1 Feb. 2, 2017

(30) Foreign Application Priority Data

Jul. 31, 2015 (JP) ..... 2015-152477

(51) Int. Cl.
*B41J 11/70* (2006.01)
*B41J 11/66* (2006.01)
*B26D 1/02* (2006.01)

(52) U.S. Cl.
CPC ..... *B41J 11/70* (2013.01); *B41J 11/66* (2013.01); *B26D 1/02* (2013.01); *B26D 1/025* (2013.01)

(58) Field of Classification Search
None
See application file for complete search history.

(56) References Cited

FOREIGN PATENT DOCUMENTS

| | | | |
|---|---|---|---|
| JP | 06-286228 A | | 10/1994 |
| JP | 2012139924 A | * | 7/2012 |
| JP | 2012-148515 A | | 8/2012 |

OTHER PUBLICATIONS

Machine Translation of JP2012139924 A, Wakita, Masaaki, "Liquid Ejection Apparatus and Liquid Ejection Method", Jul. 26, 2012, Paragraphs 0008, 0011-0013, 0015-0016, 0036, and 0050-0054].*
Machine Translation of JP2012148515 A, Sho Satoshi, "Paper Conveyance Method for Dot Line Printer", Aug. 9, 2012, 0012-0013, 0015, 0017, 0019-0020].*

* cited by examiner

*Primary Examiner* — Lisa M Solomon
(74) *Attorney, Agent, or Firm* — Foley & Lardner LLP

(57) ABSTRACT

A printer detects when printing paper S is cut by a head cover 32, and includes a vibration detector 71 for detecting vibration, a cut decision mechanism 72 for determining based on output from the vibration detector 71 if the printing paper S was cut by the head cover 32, and a cut report transmitter that reports that the printing paper S was cut.

12 Claims, 5 Drawing Sheets

PRINTER AND PAPER CUT DETECTION METHOD

This application claims priority under 35 U.S.C. §119 to Japanese Patent Application No. 2015-152477 filed on Jul. 31, 2015, the entire disclosure of which is expressly incorporated by reference herein.

BACKGROUND

Technical Field

The present disclosure relates to a printer and a cut detection method that detect paper being cut with a cutter.

Related Art

Printing devices having a conveyance mechanism (e.g., platen roller and take-up top) for conveying label tape, a thermal head for printing text on the conveyed label tape, a cutter for cutting the label tape discharged from the tape exit, a cutter lever for operating the cutter, and a detection switch that operates in conjunction with the cutter lever, are known from the literature. See, for example, JP-A-H06-286228. The printing device of JP-A-H06-286228 detects that a label tape was cut by a cutter by use of a detection switch that detects the cutting operation of the cutter, and automatically starts a label printing process triggered by detection of the label tape being cut. This enables printing continuously with intervening manual cuts.

However, because the configuration described in JP-A-H06-286228 detects the label tape being cut with the cutter by detecting the cutting operation of the cutter, the detection unit (detection mechanism, i.e. the detection switch in this example) must be located near the cutter. As a result, the detection mechanism described in JP-A-H06-286228 cannot be used in a printer with a small housing, such as a mobile printer, because space is limited and the detection unit cannot be located near the cutter. Furthermore, because the detection mechanism of JP-A-H06-286228 detects operation of the cutter, it cannot be used to detect the manual cutting of the label tape with a manual cutter that does not move (a stationary blade cutter).

SUMMARY

A printing device and a cut detection method according to the invention do not require the detection unit being near the cutter, and can also detect cutting paper with a manual cutter.

A printing device according to the invention includes: a print unit (print mechanism) that prints on paper; a cutter for cutting paper; a vibration detection unit (vibration detector) configured to detect vibration from cutting the paper; a cut decision unit (cut decision mechanism) configured to determine if the paper was cut with the cutter based on output from the vibration detection unit; and a cut report transmission unit (cut report transmitter) that reports that the paper was cut.

Preferably, the vibration detector detects vibration of the cutter during the cutting of paper.

Further preferably, the vibration detector detects vibration of the whole printing device, itself, during the cutting of paper.

Another aspect of the invention is a cut detection method including: a vibration detection step of detecting vibration; a cut decision step of determining if paper was cut using a cutter based on the output from the vibration detection step; and a cut report transmission step of sending a cut report when the cut decision step determines the paper was cut.

Thus comprised, cutting paper can be detected without the detection unit being located near the cutter because the cutting the paper is detected by detecting vibrations from cutting the paper. More specifically, because vibration from cutting the paper is transferred to the device frame and device overall, cutting the paper with the cutter can be detected by detecting this vibration even if the detection unit is not near the cutter. In other words, the detection unit can be located where desired, and the layout can be designed more freely. As a result, the detection unit can also be used in printers with a small housing, such as mobile printers. Because this configuration does not detect operation of the cutter, cutting the paper cut can be detected without using an operating cutter, or, more specifically, when using a non-operating, manual cutter.

Further preferably in a printing device according to another aspect of the invention, the cut decision unit determines if the paper was cut with the cutter based on whether or not the frequency of vibration detected by the vibration detection unit is within a specific (predefined) frequency range.

Thus comprised, cutting paper can be detected more accurately than when paper being cut is evaluated based simply on whether or not vibration is detected.

Further preferably in a printing device according to another aspect of the invention, the vibration detection unit detects vibration on three axes, an X-axis, Y-axis, and Z-axis; and the cut decision unit determines if the paper was cut with the cutter based on whether or not the frequency of a composite wave of vibration detected on the three axes is within a specific (predefined) frequency range.

This aspect of the invention determines if the paper was cut based on a composite wave of vibration detected on three axes, X-axis, Y-axis, and Z-axis, and can therefore accurately detect paper being cut even if the orientation of the device changes.

Further preferably in a printing device according to another aspect of the invention, the cutter is a manual cutter affixed in a stationary manner to a device frame.

Thus comprised, vibration from the paper being cut is transferred from the manual cutter to the device frame, and the vibration detection unit may be placed anywhere vibration of the device frame can be detected. Vibration can therefore be accurately detected even without the vibration detection unit being near the cutter.

Further preferably in a printing device according to another aspect of the invention, the cutter has a serrated cutting edge.

By using a serrated blade to cut the paper, vibration from cutting the paper is more conspicuous. Determining based on vibration whether or not the paper was cut can therefore be done more accurately.

Further preferably in a printing device according to another aspect of the invention, the vibration detection unit is mounted on a control board.

This configuration enables mounting the vibration detection unit on the same circuit board as other control systems. The vibration detection unit can therefore be located more freely, and the device can be simply constructed.

Further preferably in a printing device according to another aspect of the invention, the vibration detection unit includes an acceleration sensor, and detects the vibration by acceleration.

Further preferably in a printing device according to another aspect of the invention, the vibration detection unit includes an angular velocity sensor, and detects the vibration based on angular velocity.

Further preferably in a printing device according to another aspect of the invention, the vibration detection unit includes a sound sensor, and detects the vibration from sound.

Thus comprised, the vibration detection unit can be easily configured.

A printing device according to another aspect of the invention has a print unit configured to print on paper, a cut report transmission unit configured to report that the paper was cut, and the cut detection unit described above.

Because there is no need to locate the detection unit near the cutter, and the printing device can be configured with a cut detection device that can detect paper being cut using a manual cutter, a printing device with a simple configuration capable of continuous printing interrupted by manually cutting the paper can be provided.

Other objects and attainments together with a fuller understanding of the invention will become apparent and appreciated by referring to the following description and claims taken in conjunction with the accompanying drawings.

DESCRIPTION OF EMBODIMENTS

A cut detection device, a printing device, and a cut detection method according to preferred embodiments of the present invention are described below with reference to the accompanying figures. This embodiment of the invention describes a printing system employing the cut detection device, printing device, and cut detection method of the invention. This printing system produces printouts by a mobile printer applying a printing process to printing paper (paper) based on print commands from a mobile terminal. More specifically, in this printing system, the mobile printer has a paper cutter (cutter) embodied by a manual cutter, and uses a simple configuration to detect when the printing paper has been cut with the paper cutter.

Figure 1:
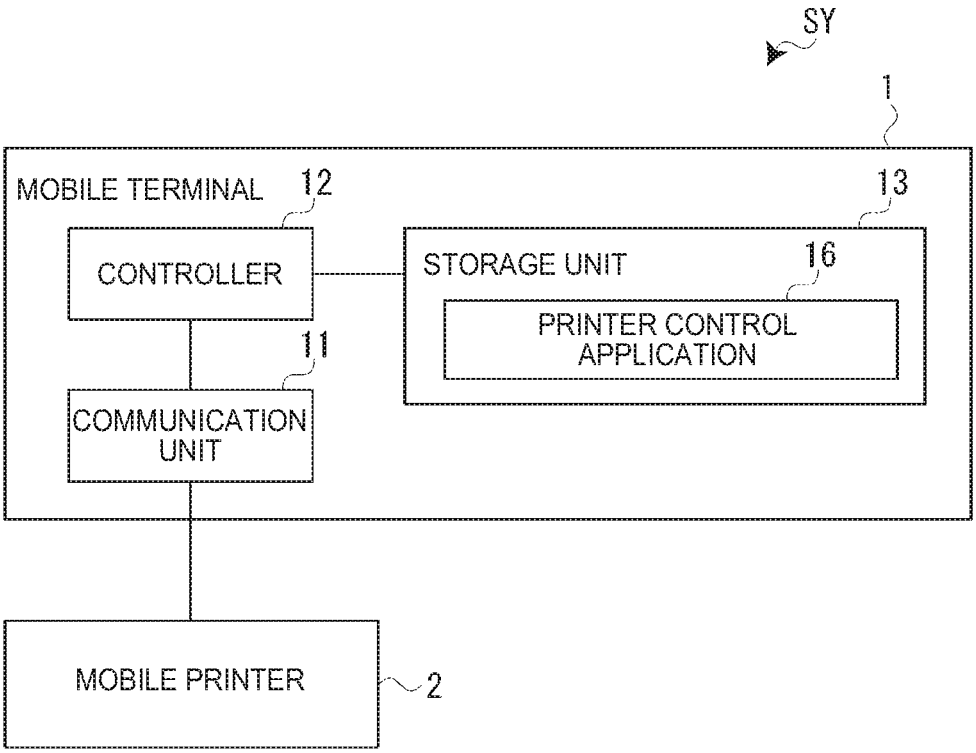
FIG. 1 illustrates the configuration of a printing system according to the invention.

As shown in FIG. 1, the printing system SY includes a mobile terminal 1 held by a user, and a small mobile printer 2 (printing device) that connects to the mobile terminal 1 and can be worn or held by the user. The printing system SY is thus a so-called mobile printing system that is held or worn by the user. The printing system SY may, for example, embody a mobile POS (point-of-sale) system for processing (sales/service) transactions at a point of sale. Note that the mobile terminal 1 and the mobile printer 2 may be configured to connect by wire or connect wirelessly. The mobile terminal 1 and mobile printer 2 may also be configured to connect directly to each other, or to connect indirectly to each other through a computer network (such as the Internet or a local area network).

The mobile terminal 1 may be a smartphone or tablet computer, for example, and preferably functions as a host device (i.e., a host computer) that controls printing by the mobile printer 2, which may function as a periphery device to mobile terminal 1. The mobile terminal 1 preferably includes a communication unit 11, controller 12, and a storage unit 13.

The communication unit 11 communicates with the mobile printer 2. More specifically, the communication unit 11 sends commands including print commands to the mobile printer 2, and receives data from the mobile printer 2.

The controller 12 includes a CPU (Central Processing Unit), RAM (Random Access Memory), ROM (Read Only Memory), and centrally controls the mobile terminal 1.

The storage unit 13 is flash ROM, for example, and stores a printer control application 16 for controlling the mobile printer 2. The mobile terminal 1 functions as a host device by the controller 12 running the printer control application 16.

Figure 2A:
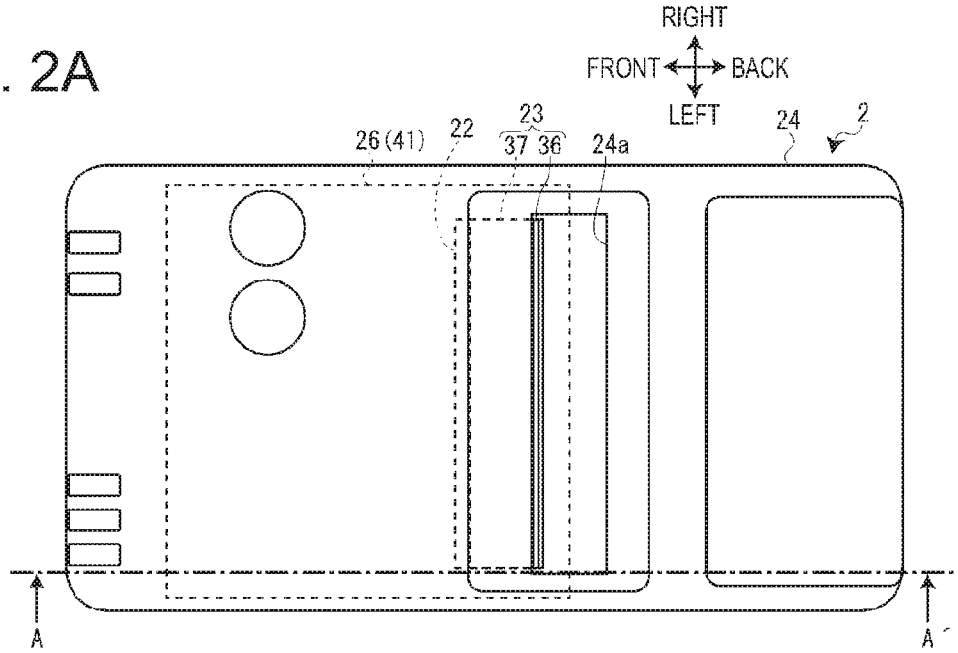
FIG. 2A shows a plan view of a mobile printer in accord with the present invention.
Figure 2B:
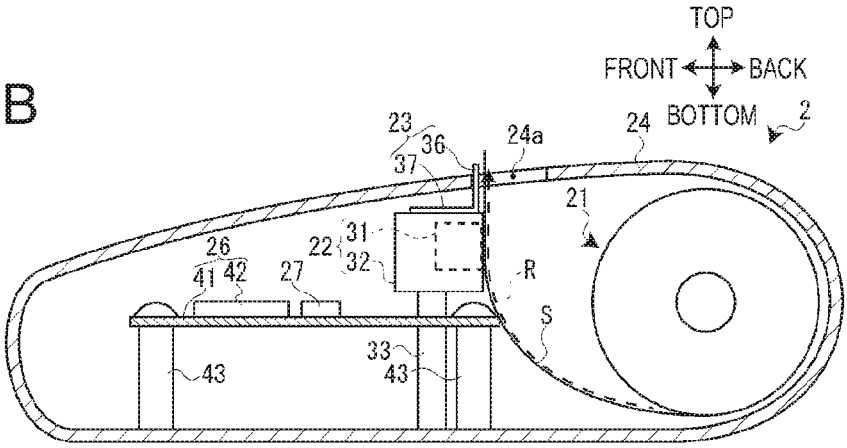
FIG. 2B shows a section view of the mobile printer through line A-A in FIG. 2A.

The mobile printer 2 is described next referring to FIG. 2. As shown in FIG. 2, the mobile printer 2 has a paper storage unit 21 that holds the printing paper S, which in this example is thermal roll paper; a paper feed unit (not shown in the figure) that conveys the printing paper S from the paper storage unit 21 through the conveyance path R; a head unit 22 that prints on the conveyed printing paper S; a paper cutter 23 (cutter) for cutting the printed portion of the printing paper S; and a device frame 24 (device cover) that covers and supports these other components.

The printing paper S delivered from the paper storage unit 21 is conveyed by a conveyance unit through the conveyance path R, and is printed on by the head unit 22. The printed portion of the printing paper S is conveyed to the outside by the paper feed unit through a paper exit 24*a* formed in the device frame 24. The user then acquires the resulting printout by cutting off the printed portion (printout) of the discharged printing paper S with the paper cutter 23, which is a manual cutter.

The mobile printer 2 has a control board 26 including the controller 42 that controls the paper feed unit and the head unit 22; a triaxial accelerometer 27 (acceleration sensor) disposed with the controller 42 on the control board 26; and a communication unit (not shown in the figure) for communicating with the mobile terminal 1.

The head unit 22 includes a thermal printhead 31 that prints by a thermal printing process on the printing paper S, which is thermal paper in this example; and a box-like head cover 32 that covers and supports the thermal printhead 31. The head unit 22 is supported by the device frame 24 through a support member 33 at a specific position facing the conveyance path R.

The paper cutter 23 is a manual cutter that is fixed on the head unit 22 (head cover 32). More specifically, the paper cutter 23 is fastened to the device frame 24 through the head unit 22 and support member 33. Yet more specifically, the paper cutter 23 comprises a cutter knife 36 formed along the conveyance path R, and a fastened portion 37 that is formed by bending the trailing end of the cutter knife 36. The paper cutter 23 is fastened with the cutter knife 36 at the paper exit 24*a* by fastening the fastened portion 37 to the head cover 32. More specifically, the paper cutter 23 is fastened with the cutter knife 36 near the front edge of the paper exit 24*a*, and the distal end of the cutter knife 36 protruding slightly from the paper exit 24*a*. When the user cuts the printing paper S using the paper cutter 23 (cuts off the printed portion), the user pulls the leading end of the printing paper S to the cutter knife 36 side and cuts the printing paper S by pulling the printing paper S against the cutter knife 36. In other words, the printing paper S is cut in this configuration by pressing the printing paper S against the cutter knife 36 and gradually cutting the printing paper S from one side of its width to sever the printed portion (leading end) of the printing paper S.

The cutter knife 36 in this example is a serrated cutter knife 36, with the cutting edge of the cutter knife 36 being serrated. In other words, the printing paper S is cut with a serrated blade in this embodiment of the invention. As a result, the printing paper S can be cut easily, and detecting vibrations produced when cutting the printing paper S is easier.

The control board 26 includes a printed circuit board 41, and a controller 42 mounted on the printed circuit board 41. The printed circuit board 41 is fastened at four corners to the device frame 24 by four fasteners 43. More specifically, the printed circuit board 41 is fastened to the device frame 24 through the four fasteners 43. The controller 42 includes a CPU, ROM, and RAM, and centrally controls the mobile printer 2.

The triaxial accelerometer 27 is mounted with the controller 42 on the printed circuit board 41, and detects acceleration on the X, Y, and Z axes. The X-axis is one direction on the same plane as the mounting surface of the printed circuit board 41, and the Y-axis is the direction perpendicular to the X-axis on the same plane as the mounting surface of the printed circuit board 41. The Z-axis is the direction perpendicular to the mounting surface of the printed circuit board 41, and perpendicular to the X-axis and the Y-axis. As described further below, the triaxial accelerometer 27 is used to detect vibration from cutting the printing paper S. Note that because the printed circuit board 41 is fastened to the device frame 24 through the four fasteners 43, the triaxial accelerometer 27 is also fastened to the device frame 24 through the printed circuit board 41 and fasteners 43. As a result, vibration of the device frame 24 when cutting the printing paper S can be detected by the triaxial accelerometer 27.

Figure 3:
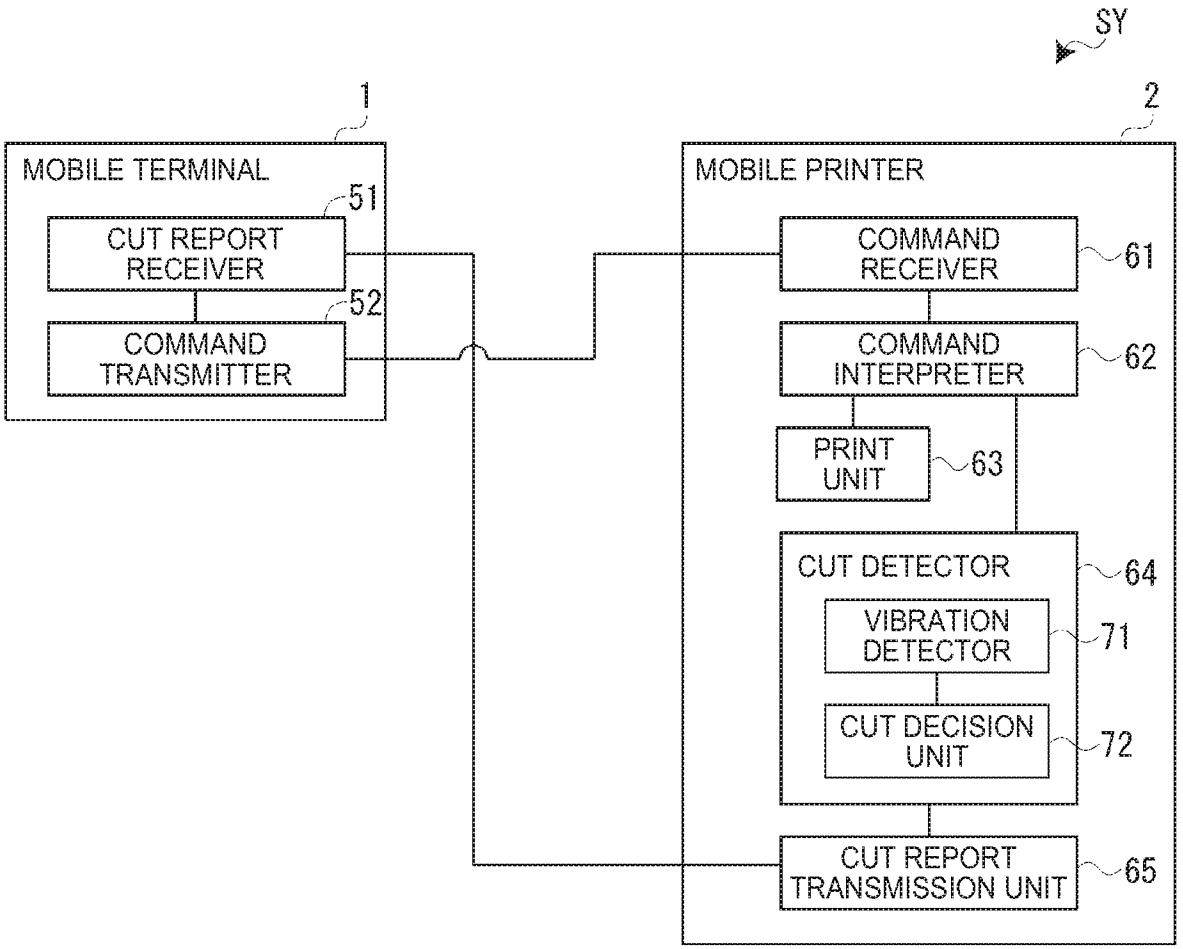
FIG. 3 is a function block diagram illustrating a functional configuration of a mobile terminal and a mobile printer in accord with the present invention.

The functional configuration of the mobile terminal 1 and mobile printer 2 is described next with reference to FIG. 3. The functional configuration of the mobile terminal 1 is described first. As shown in FIG. 3, the mobile terminal 1 has a cut report receiver 51, and a command transmitter 52. The cut report receiver 51 and command transmitter 52 are embodied by the communication unit 11 and the controller 12 executing a printer control application 16.

The cut report receiver 51 receives a cut report from the mobile printer 2. The cut report indicates that the printing paper S was cut by use of the paper cutter 23. By receiving a cut report from the mobile printer 2 through the cut report receiver 51, the mobile terminal 1 knows that the user of the mobile printer 2 cut the printing paper S with the paper cutter 23.

The command transmitter 52 sends commands to the mobile printer 2 and controls the mobile printer 2. More specifically, the command transmitter 52 sends print commands to the mobile printer 2, and causes the mobile printer 2 to execute a printing process. The command transmitter 52 also sends to the mobile printer 2 a start detection command for starting the operation of detecting cutting of the printing paper S (described below) The start detection command causes the mobile printer 2 to start detecting the printing paper S cutting operation.

The functional configuration of the mobile printer 2 is described next. The mobile printer 2 has a command receiver 61, a command interpreter 62, a print unit 63, a cut detector 64, and a cut report transmission unit 65. A cut detection device is embodied by the paper cutter 23 and cut detector 64.

The command receiver 61 is embodied by a communication unit and controller 42, and receives commands from the mobile terminal 1. More specifically, the command receiver 61 receives print commands and start detection commands transmitted from the mobile terminal 1.

The command interpreter 62 is embodied by the controller 42, interprets received commands, and determines the type of command that was received.

The print unit 63 is embodied by the paper feed unit, thermal printhead 31, and controller 42. The print unit 63 may also be termed a print engine. If the result of command interpretation by the command interpreter 62 is that the received command is a print command, the print unit 63 executes a printing process based on the print command, and thereby prints and outputs the printout (the printed portion of the printing paper S). More specifically, based on the received print commands, the print unit 63 prints on the conveyed printing paper S while conveying the printing paper S, and discharges the printed portion (the printout) from the paper exit 24*a* to the outside.

The cut detector 64 detects cutting the printing paper S with the paper cutter 23. More specifically, the cut detector 64 detects the user using the paper cutter 23 to cut the printing paper S. Yet more specifically, the cut detector 64 includes a vibration detector 71 that detects vibrations created by cutting the printing paper S, and a cut decision unit 72 that determines if the printing paper S was cut based on the output from the vibration detector 71.

The vibration detector 71 is embodied by the triaxial accelerometer 27, and detects vibration based on acceleration. More specifically, the vibration detector 71 detects vibration on the X-axis, Y-axis, and Z-axis, and detects vibration on the three axes (X-axis, Y-axis, and Z-axis) based on the detected acceleration. Note that as described above, because the paper cutter 23 is fastened to the device frame 24 through the head unit 22 and support member 33, vibration of the paper cutter 23 when cutting the printing paper S is transferred through the head unit 22 and support member 33 to the device frame 24. The vibration detector 71 therefore detects vibration of the device frame 24. More specifically, because the triaxial accelerometer 27 is fastened to the device frame 24 through the printed circuit board 41 and fasteners 43, the vibration detector 71 detects vibration of the device frame 24 through the printed circuit board 41 and fasteners 43.

The cut decision unit 72 is embodied by the controller 42, and determines whether or not the printing paper S was cut with the paper cutter 23 based on whether or not the frequency of vibrations detected by the vibration detector 71 is within a specific (predefined) frequency range. More specifically, based on the detection result from the vibration detector 71, the cut decision unit 72 obtains a composite wave of the vibrations on three axes, and acquires the frequency of the composite wave by signal processing the composite wave using a Fourier transform, for example. The cut decision unit 72 determines if the frequency of the composite wave is within a specific frequency range, determines the printing paper S was cut with the paper cutter 23 if the frequency of the composite wave is within the specific frequency range, and determines the printing paper S was not cut with the paper cutter 23 if the frequency of the composite wave is not within the specific frequency range.

Figure 4:
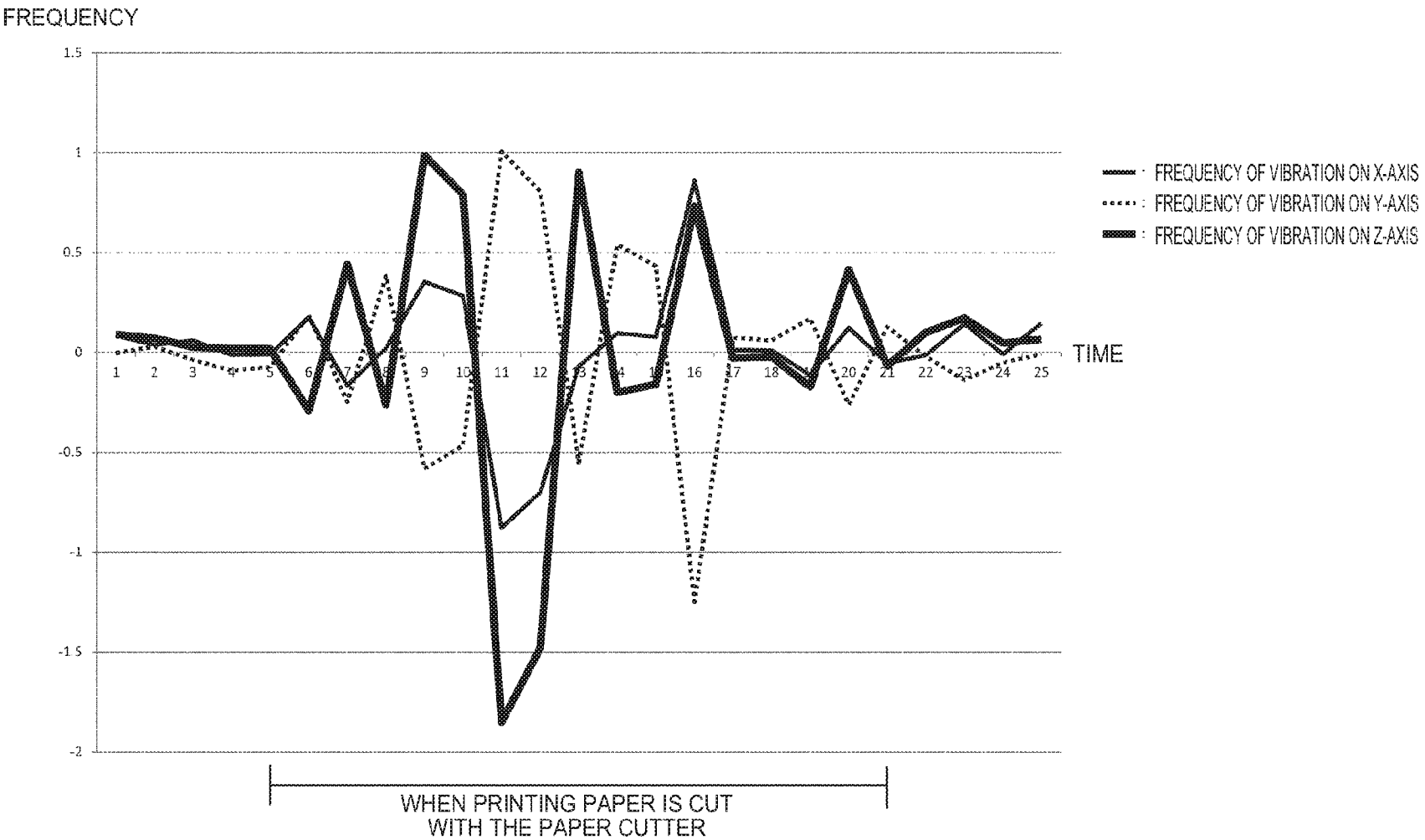
FIG. 4 is a graph showing a frequency of vibrations when cutting printing paper.

This specific frequency range is a range of frequencies expected to be produced when the printing paper S is cut with the paper cutter 23, and is set in this example based on the results of previous tests. For example, as shown in FIG. 4, the frequency of vibrations on three axes when the printing paper S is cut with the paper cutter 23 are obtained by experiments (note that the data in FIG. 4 excludes gravitational acceleration). The specific frequency range is set based on the experimental results. Note that because the cutting speed may vary with the user, the specific frequency range is preferably set to allow for differences in the cutting speed.

Referring again to FIG. 3, the cut report transmission unit 65 is embodied by a communication unit and the controller 42, and sends a cut report to the mobile terminal 1 when the cut detector 64 detects that the printing paper S was cut by the paper cutter 23. More specifically, the cut report transmission unit 65 reports to the mobile terminal 1 when the printing paper S is cut by the paper cutter 23.

The continuous printing operation of the printing system SY is described next with reference to FIG. 5. This continuous printing operation is an operation that prints (produces) two printouts interrupted by manually cutting the printing paper S with the paper cutter 23. More specifically, in this continuous printing operation, one printout is printed first, the user then cuts off that one printout manually using the paper cutter 23, and the second printout is then printed. For example, the first printout may be the customer's copy of a receipt, and the second printout may be the store's copy of the same receipt.

Figure 5:
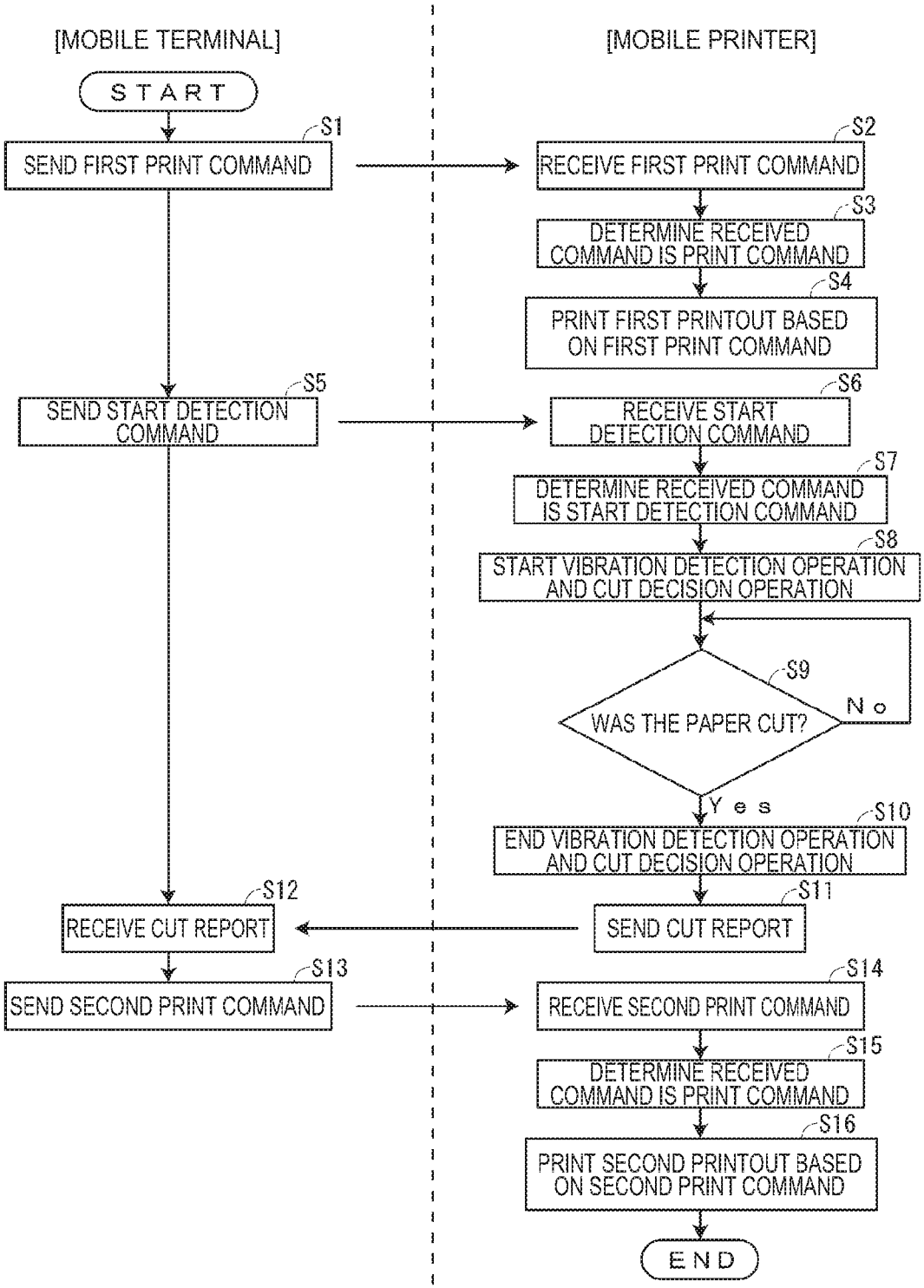
FIG. 5 is a flow chart of the continuous printing operation of the printing system.

As shown in FIG. 5, this continuous printing operation starts with the mobile terminal 1 sending a print command (referred to below as the first print command) for printing the first printout to the mobile printer 2 by means of the command transmitter 52 (S1). The mobile printer 2 then receives the first print command from the mobile terminal 1 through the command receiver 61 (S2), and the command interpreter 62 interprets the received command and determines the command is a print command (S3). The print unit 63 then prints the first printout (S4) based on the received first print command. In other words, based on the first print command, the print unit 63 conveys the printing paper S, prints on the conveyed printing paper S, and discharges the printed portion (first printout) from the mobile printer 2 through the paper exit 24*a*.

When transmission of the first print command ends and printing the first printout ends, the mobile terminal 1 sends a start detection command to the mobile printer 2 by the command transmitter 52 (S5).

The mobile printer 2 then receives the start detection command from the mobile terminal 1 through the command receiver 61 (S6), interprets the command with the command interpreter 62, and determines the received command is a start detection command (S7). The cut detector 64 then receives the start detection command and starts the operation detecting if the printing paper S is cut with the paper cutter 23. More specifically, the cut detector 64 starts the vibration detection operation of the vibration detector 71 and the cut decision operation of the cut decision unit 72 (S8). In other words, while the vibration detector 71 drives the triaxial accelerometer 27 and continuously detects vibration (vibration detection step), the cut decision unit 72 sequentially determines if the frequency of vibrations detected by the vibration detector 71 is within the specific frequency range, and continuously determines if the printing paper S was cut by the paper cutter 23 (cut decision step).

If the printed portion (first printout) of the printing paper S was cut off by the user with the paper cutter 23, and the cut decision unit 72 determines that the printing paper S was cut by the paper cutter 23 (that is, cutting the printing paper S was detected by the cut detector 64) (S9: YES), the operation of the cut detector 64 detecting if the printing paper S was cut ends. More specifically, the triaxial accelerometer 27 turns off, and the vibration detection operation of the vibration detector 71 and the cut decision operation of the cut decision unit 72 end (S10). The cut report transmission unit 65 then sends a cut report to the mobile terminal 1 (S11).

The mobile terminal 1 then receives the cut report from the mobile printer 2 through the cut report receiver 51 (S12), and based thereon sends a print command (referred to below as the second print command) for printing the second printout to the mobile printer 2 by means of the command transmitter 52 (S13). In other words, sending the second print command is triggered by receiving the cut report. The mobile printer 2 then receives the second print command from the mobile terminal 1 through the command receiver 61 (S14), and determines if the received command is a print command by interpreting the command with the command interpreter 62 (S15). Based on the received second print command, the print unit 63 then prints the second printout (S16). In other words, based on the second print command, the print unit 63 conveys the printing paper S, prints on the conveyed printing paper S, and discharges the printed portion (second printout) from the mobile printer 2 through the paper exit 24*a*. This completes the printing operation in this embodiment of the invention.

The embodiment of the invention thus comprised is configured to detect cutting of the printing paper S by the cut detector 64 detecting the vibrations that are produced when the printing paper S is cut, and can therefore detect cutting the printing paper S without the detector being located near the cutter. The detector can therefore disposed where desired, and the freedom of layout is improved. Furthermore, because the invention does not detect operation of the paper cutter 23, cutting the printing paper S can be detected even if the cutter is not an operable (moving) cutter, that is, the cutter is a non-movable manual cutter.

Furthermore, because the cut decision unit 72 is configured to determine if the printing paper S was cut by the paper cutter 23 based on whether or not the frequency of vibrations detected by the vibration detector 71 is within a specific frequency range, cutting the printing paper S can be determined (detected) more reliably than if cutting the printing paper S is determined based simply on whether or not vibration is detected.

Furthermore, because cutting the printing paper S is determined using a composite wave of vibrations on three axes (X-axis, Y-axis, Z-axis), cutting the printing paper S can be detected with good reliability even if the orientation of the mobile printer 2 changes. That is, the vibration results in each of the three axes can be separately compared to their respective specific frequency range that has been determined to correspond to a cutting operation. In this manner, if vibrations in all three axes correspond to their respective frequency range, then it can be confidently concluded that a cutting operation has been executed. Yet further, because the paper cutter 23 is a manual cutter fastened to the device frame 24, vibrations from cutting the printing paper S are passed from the manual cutter to the device frame 24. As a result, vibrations can be accurately detected without the vibration detector 71 (triaxial accelerometer 27) being near the cutter.

Furthermore, because the paper cutter 23 has a serrated cutter knife 36, the printing paper S can be cut with a serrated edge. Vibration from cutting the printing paper S is therefore well defined since the serrated edge provides a predictable series of stabbing and slicing/cutting actions on the printing paper. As a result, determining based on vibration if the paper was cut is reliable.

Furthermore, because the vibration detector 71 (triaxial accelerometer 27) is disposed to the control board 26, the vibration detector 71 can be disposed to the same circuit board as other control systems, and is not restricted to being closed to the cutter. The vibration detector 71 can therefore be conveniently disposed, and the configuration of the mobile printer 2 can be simplified.

Because the cut detection operation (vibration detection operation and cut decision operation) are preferably initiated only immediately following completion of the first printout, vibration from printing will not be erroneously detected as vibration from cutting, and cutting will not be falsely detected. More specifically, detection errors can be significantly reduced because cutting detection by the cut detector 64 is performed only when cutting the printing paper S with the paper cutter 23 is expected.

The vibration detector 71 (triaxial accelerometer 27) in the foregoing embodiment is disposed to the control board 26, but the invention is not so limited. For example, the vibration detector 71 (triaxial accelerometer 27) may be directly fastened to the device frame 24.

The foregoing embodiment of the invention has a cut detector 64 disposed to a device (mobile printer 2) having a paper cutter 23, but configurations in which the cut detector 64 is disposed to a separate device than the device having the paper cutter 23 are also conceivable. More specifically, configurations that detect vibration from cutting with the paper cutter 23 in a separate device are also conceivable.

The foregoing embodiment uses an accelerometer in the vibration detector 71, and detects vibration from cutting the printing paper S based on acceleration, but the invention is not so limited.

For example, the vibration detector 71 may be configured with an angular velocity sensor (gyro sensor), and detect vibration from cutting the printing paper S based on the angular velocity matching a predefined angular velocity range. Further alternatively, the vibration detector 71 may be configured with a sound sensor, and detect vibration from cutting the printing paper S based on the detected sound. In this case, the controller would further execute signal processing to determine when features of a detected sound match predetermined features corresponding to a typical paper cutting operation.

In the cut decision unit 72 in the foregoing embodiment, cutting is determined based on the frequency of vibration detected by the vibration detector 71 being within a specific frequency range, but any configuration enabling detecting cutting the paper based on the output of a vibration detector 71 may be used. For example, the cut decision unit 72 may be configured to evaluate cutting based on whether or not vibration is detected by the vibration detector 71. More specifically, the cut decision unit 72 determines the printing paper S was cut if any vibration (of minimum predetermined time length) is detected by the vibration detector 71, and determines the printing paper S was not cut if the expected vibration is not detected by the vibration detector 71.

The foregoing embodiment is configured to continuously print two printouts in the continuous printing operation, but the continuous printing operation may be configured to continuously print three printouts. In this event, a start detection command is sent to the mobile printer 2 to start the cut detection operation after the second print command is sent to the mobile printer 2, and a third print command is transmitted when the cut detection report is then received from the mobile printer 2. Configurations that continuously print four or more printouts in the continuous printing operation are obviously also conceivable.

The foregoing embodiment is configured to send a start detection command after sending the first print command, but may be configured to add and send the start detection command with the first print command at the end (trailing end).

In the embodiment described above, the mobile printer 2 sends a cut report to the mobile terminal 1 after detecting that the printing paper S was cut, and upon receiving this cut report the mobile terminal 1 sends a second print command to the mobile printer 2 to print a second printout, but the invention is not so limited. For example, configurations that send the print data for the second printout in advance, and automatically print the second printout when triggered by the printing paper S being cut, are also conceivable.

In this embodiment of the invention the function of sending the start detection command to the mobile printer 2 and receiving the cut detection report from the mobile printer 2 may be provided an application programming interface (API).

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing device comprising:

a print mechanism configured to print on paper;

a cutter configured to cut paper;

a vibration detector configured to detect vibration of the printing device during cutting of the paper; and a cut decision mechanism configured to determine if the paper was cut with the cutter based on output from the vibration detector.

2. The printing device described in claim 1, wherein:

the cut decision mechanism is configured to determine if the paper was cut with the cutter based on whether or not a frequency of vibration detected by the vibration detector is within a predefined frequency range.

3. The printing device described in claim 1, wherein:

the vibration detector is configured to detect vibration on three axes, an X-axis, Y-axis, and Z-axis; and the cut decision mechanism is configured to determine if the paper was cut with the cutter based on whether or not the frequency of a composite wave of vibration detected on the three axes is within a predefined frequency range.

4. The printing device described in claim 1, further comprising:

a cut report transmitter configured to transmit a cut report when the cut decision mechanism determines the paper was cut.

5. The printing device described in claim 1, wherein:

the cutter is a manual cutter affixed in a stationary manner to a device frame.

6. The printing device described in claim 5, wherein:

the cutter has a serrated cutting edge.

7. The printing device described in claim 1, wherein:

the vibration detector is mounted on a control board.

8. The printing device described in claim 1, wherein:

the vibration detector includes an acceleration sensor, and is configured to detect the vibration by acceleration.

9. The printing device described in claim 1, wherein:

the vibration detector includes an angular velocity sensor, and is configured to detect the vibration based on angular velocity.

10. The printing device described in claim 1, wherein:

the vibration detector includes a sound sensor, and is configured to detect the vibration based on sound.

11. The printing device described in claim 1, wherein the vibration detector is configured to detect vibration of the cutter during the cutting of paper.

12. A cut detection method comprising:

a vibration detection step of detecting vibration of a printing device during cutting of paper;

a cut decision step of determining if the paper was cut using a cutter based on the output from the vibration detection step; and a cut report transmission step of sending a cut report when the cut decision step determines that paper was cut.

* * * * *